US006401498B1

(12) United States Patent
Fujiwara

(10) Patent No.: US 6,401,498 B1
(45) Date of Patent: Jun. 11, 2002

(54) GARMENT AND METHOD FOR PROVIDING THEREOF

(75) Inventor: Toshio Fujiwara, Tokyo (JP)

(73) Assignee: Kabushiki Kaisha Miyake Design Jimusho, Tokyo (JP)

( * ) Notice: Subject to any disclaimer, the term of this patent is extended or adjusted under 35 U.S.C. 154(b) by 0 days.

(21) Appl. No.: 09/616,517

(22) Filed: Jul. 14, 2000

(30) Foreign Application Priority Data

Dec. 27, 1999 (JP) ..... 11-371037

(51) Int. Cl.[7] ..... D04B 21/00; A41D 27/10

(52) U.S. Cl. ..... 66/195; 66/176; 2/243.1; 2/269

(58) Field of Search ..... 2/269, 243.1, 69, 2/77, 90, 115, 125, 123, 106, 227; 66/169 R, 170, 171, 172 R, 174, 175, 176, 177, 178 R, 195, 196

(56) References Cited

U.S. PATENT DOCUMENTS 1,831,192 A * 11/1931 Persky ..... 66/176
2,010,936 A * 8/1935 Van Arsdale et al. ..... 66/195
2,227,214 A * 12/1940 Bisberg ..... 2/269
2,657,159 A * 10/1953 Nahman ..... 2/243.1
2,669,726 A * 2/1954 Bisberg ..... 2/269
2,724,120 A * 11/1955 Biern ..... 2/269
2,985,887 A * 5/1961 Lindley ..... 2/269
3,601,817 A * 8/1971 Abrams ..... 2/269
3,665,516 A * 5/1972 Orovan ..... 2/269
3,872,512 A * 3/1975 Ambrosiani ..... 2/73
3,985,003 A * 10/1976 Reed ..... 66/196
4,118,802 A * 10/1978 Polster ..... 2/84
5,081,854 A * 1/1992 Lonati ..... 66/176
5,153,944 A * 10/1992 Teel ..... 2/243 R
5,539,932 A * 7/1996 Howard ..... 2/269
5,669,077 A * 9/1997 Stewart ..... 2/227
5,864,891 A * 2/1999 Gonzales ..... 2/406
6,055,673 A * 3/2000 McCormick ..... 2/227
6,145,348 A * 11/2000 Hardegree et al. ..... 66/195
6,327,711 B1 * 12/2001 Fujiwara ..... 2/243.1

* cited by examiner

*Primary Examiner*—Amy B. Vanatta
(74) *Attorney, Agent, or Firm*—Pitney, Hardin, Kipp & Szueh LLP

(57) ABSTRACT

A warp-knitted fabric from which garments can be obtained without accompanying any sewing process. The fabric is constructed by first and second layers 10 and 12, which construct first and second sides, respectively of garments and which are basically separated from each other. The first and second layers are connected with each other along an outline 14 of the garment. At locations corresponding to sleeves of the garment, the fabric is integrated with indicator lines CL1, CL2 and CL3 for effecting a cutting of the garment at the sleeve portions. A wearer selects one of the indicator lines and uses the selected line as a guide for effecting a cutting at the sleeve portions so that a desired sleeve length which is best fitted to the wearer is obtained.

2 Claims, 3 Drawing Sheets

GARMENT AND METHOD FOR PROVIDING THEREOF

BACKGROUND OF THE INVENTION

1. Field of the Invention

The present invention relates to a garment with no sewing, which is cut from a continuous lengths of warp-knitted fabric and a method for providing such a kind of garments.

2. Description of Related art

In conventional method for producing a ready made garment, a fabric after a weaving or knitting process is, first, subjected to a cutting to various parts of the garment, such as a front body, a back body and a collar by using respective pattern papers. After the cutting, a sewing process is done by which the various parts are connected with each other to a garment. As far as a size matter is concerned, a conformity will, of course, be obtained between a wide range of wearers by increasing number of selectable sizes. However, an increase in the number of available sizes results in an unbearable increase in a number in the pattern papers, which makes the number of sewing process to be increased, thereby increasing a labor cost in a garment production. Thus, it is quite usual that selectable sizes are limited to a small number such as three, i.e., a large size (L), a medium size (M) and a small size (S).

However, a demand of wearer is reasonable that the garments should be the ones that are best fitted to their sizes as well as to their preference. Thus, there is certain dissatisfaction for many wearers as to the present status of ready-made garments that the capability of size selection is highly limited. Thus, there has been long felt need as to garments which can provide an increased capability of size adjustment.

SUMMARY OF THE INVENTION

An object of the present invention is to provide a garment capable of providing a desired easy and reliable size adjustment without accompanying sewing process.

An object of the present invention is to provide a garment capable of providing a possibility of desired size adjustment without accompanying any extra cost.

According to the present invention, a garment is provided, which comprises a front and a back bodies which are separated from each other and stitching parts which connect, along an outline of the garment, the front and back bodies with each other except at locations such as sleeve or a neck where parts of a human body is passed, these front and back bodies as well as stitching parts being constructed as warp-knitted fabrics, said garment further comprising, at said locations, indicators for allowing a size adjustment by cutting to be guided.

A knitting of such a construction of warp-knitted fabric can be attained by a warp knitting machine having at least two ground guide bars and at least two jacquard guide bars. Namely, the warp knitting of one of the two layers constructing the garment is done by using the first ground guide bar while the warp knitting of the other layer is done by using the second ground guide bar. The warp knitting of the portion for stitching the first and second layers along the contour line of the garment is done by using the jacquard guide bars.

A technique for creating a garment integrally in a warp-knitted fabric is, also, disclosed in Japanese Examined Patent Publication (kokoku) No. 52-12306 or Japanese UnExamined Utility Model Publication (kokai) No. 62-153304. Namely, these prior arts propose a formation of a garment integrated into a warp-knitted fabric during a knitting operation by a warp knitting machine having two row of needle beds. By using the warp knitting machine, two layer can be knitted separately while allowing the two layers to be desirably stitched with each other in such a manner that one of the layer becomes to be a front body of a garment while the other layer becomes to be a back body of the garment and that the two layers are stitched with each other along the outline of the garment. Thus, knitting of the warp-knitted fabric according to the present invention is realized also by the technique as disclosed in the above Japanese Patent or Utility Model Publication.

Furthermore, in the construction according to the present invention, indicators are provided, by which an adjustment of size such as sleeve length or body length is eased at locations of the garment, such as a sleeve or neck where parts of wearer's body are passed. Namely, a wearer effects a cutting along a desired cutting line assisted by an indicator which is selected by the wearer and is the nearest to the desired cutting line. The indicators are, for example, constructed by marks such as S(small size), M(Medium size) and L(Large size). It should be noted that the cutting is not necessarily precisely conformed to the mark S, M or L. Namely, the selected mark is only for used as a guide or assistance for cutting along a desired free line which is matched to the particular wearer's size and/or his or her preference. When a wearer's size is slightly larger than the medium standard size, the cutting will be done along a line adjacent the indicator (mark) M, so that a desired length (sleeve length or body length) is obtained. Thus, when compared with a prior art where a selection of a size is limited to only one from predetermined fixed sizes such as S, M and L, the idea of the present invention is highly advantageous in that the sleeve length or body length or neck hole can be adjusted limitlessly rather than step like control in the prior art. Thus, the present invention allows the garment to be best fitted to the wearer's particular size and/or his or her preference.

As explained above, the essence of the present invention is in an idea that an adjustment of the sleeve length or body length is done by allowing a cutting along a freely or steplessly determined line. What is important with reference to this idea of free cutting for limitless adjustment of sleeve length or body length according to the present invention is that the fabric according to the present invention is warp-knitted fabric. Namely, in a weft knitted fabric or woven fabric, an exposure of ends of yarns constructing the fabric by a cutting along a line causes the yarn to be very easily loosened. Thus, in the weft knitted fabric or woven fabric, an additional sewing process along the cut line is essential for preventing the yarns from being loosened. On the other hand, a warp-knitted fabric provides a structure where warp yarn loops are laterally displaced in a wales direction, i.e., the direction which is transverse to the warp yarns in such a manner that a complicated engagement of warp yarn loops is obtained in the wales direction, i.e. the direction transverse to warp yarns. Due to such a complicated engaged structure of yarn loops in the warp-knitted fabric, a loosening of yarns is less likely even if the fabric is subjected to a cutting along a desired line for providing a desired sleeve length or desired body length or desired shape of neck hole.

According to another aspect of the present invention, a method is provided for providing garments comprising the steps of:

knitting a fabric having layers which are separate from each other and which are to be front and back bodies of the garments, while the fabric has portions whereat the layers are stitched with each other along the outlines of the garments;

forming, simultaneously with the knitting of the fabric, at the locations of the fabric where portions of a human body are passed, such as a sleeve, indicators which are the indicative for a wearer for guiding him or her to effect a size adjustment;

cutting the fabric along said outline of the garment so that the garment is separated from the fabric;

under the guidance of the one of the indicators, selected by the wearer based on his or her size as well as the preference, cutting the garment at said location of the garment whereat the size adjustment is necessary, thereby providing the desired size of the garment at said location which is matched with the wearer's size as well as preference, without accompanying any sewing process.

In the above method, said indicator is, preferably, integrated to the fabric during the execution of the warp knitting for forming said fabric.

BRIEF EXPLANATION OF ATTACHED DRAWING

DETAILED EXPLANATION OF PREFERRED EMBODIMENT

Figure 1:
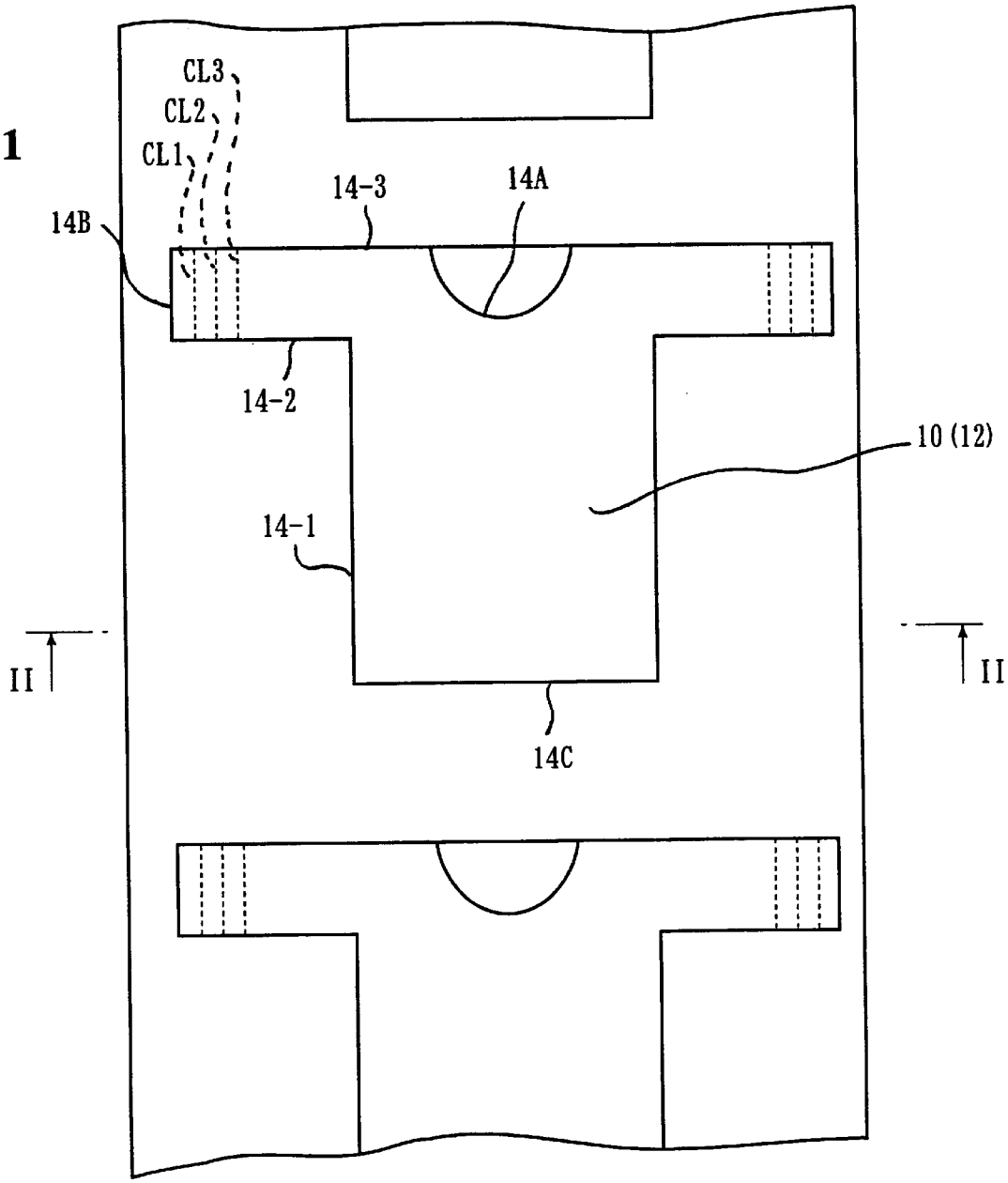
FIG. 1 is a schematic view of a warp-knitted fabric in which T-shirts are integrally incorporated according to the present invention.
Figure 2:
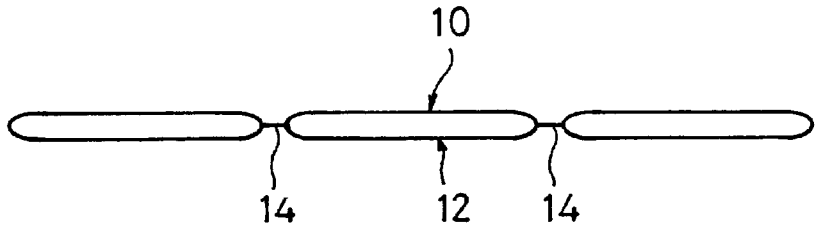
FIG. 2 is a cross-sectional view taken along line II—II in FIG. 1.

FIGS. 1 and 2 show a hose shaped warp-knitted fabric according to the present invention, which is provided with a first or front layer 10 and a second or back layer 12, which are basically separated from each other. The first and second layers 10 and 12 become one side (front body) and the other side (back body) of the garment, i.e., T-shirt in the present embodiment when it is cut out from the fabric. It should be noted that integration of the garments in the warp-knitted fabric is such that a repetition of the garments are created along the length of the warp-knitted fabric, i.e., along the direction of the warp yarns.

In FIG. 1, the first and second layers of the warp-knitted fabric which becomes a front and back bodies of a garment when the latter is separated from the fabric are connected integrally with each other by stitching lines 14-1, 14-2 and 14-3. These stitching lines 14-1, 14-2 and 14-3 are generally designated by a numeral 14 in FIG. 2. As shown in FIG. 1, the stitching lines 14-1, 14-2 and 14-3 run along an outline of the garment. Namely, the lines 14-1 correspond to side lines of the body, the lines 14-2 correspond to lines from the armpit to the sleeve opening and the line 14-3 correspond to lines from the shoulder to the sleeve opening.

In FIG. 1, a line 14A represents a neck hole of T-shirt, 14B an opening at a sleeve, and 14C an opening at a hemline. At these opened portions, no stitching exists between the upper and lower layers 10 and 12. In other words, at the neck 14A, the sleeve 14B and the hemline 14C, the upper and lower layers 10 and 12 are separated, thereby providing thereat respective openings.

In FIG. 1, the fabric is formed with guide lines CL1, CL2 and CL3 at locations of sleeves of the garment (T-shirt) integrated with the fabric. After the separation of the garment from the fabric, these guide lines CL1, CL2 and CL3 are for guiding a wearer to effect a cutting at the sleeve portions of the garment in such a manner a desired sleeve length is obtained, which is the best matched to the particular size of a wearer and/or his or her preference. Namely, these guide lines CL1, CL2 and CL3 correspond, respectively, standard lines corresponding, respectively, to standard sizes, for example S (small) size, M (medium) size and L (large) size. First, a wearer selects one of the lines which is the nearest to his or her particular size. Then, under the guide or assist of the selected line, the wearer effect a cutting at the sleeve portion of the garment in such a manner that a desired sleeve length, which is matched to his or her size as well as to his or her preference, is obtained. Namely, just after the cutting from the fabric, the cut line at the sleeve portion is designated by the line 14B, which provides a sleeve length which should be referred as LL size which is larger than the sleeve length of at standard L size.

Figure 3:
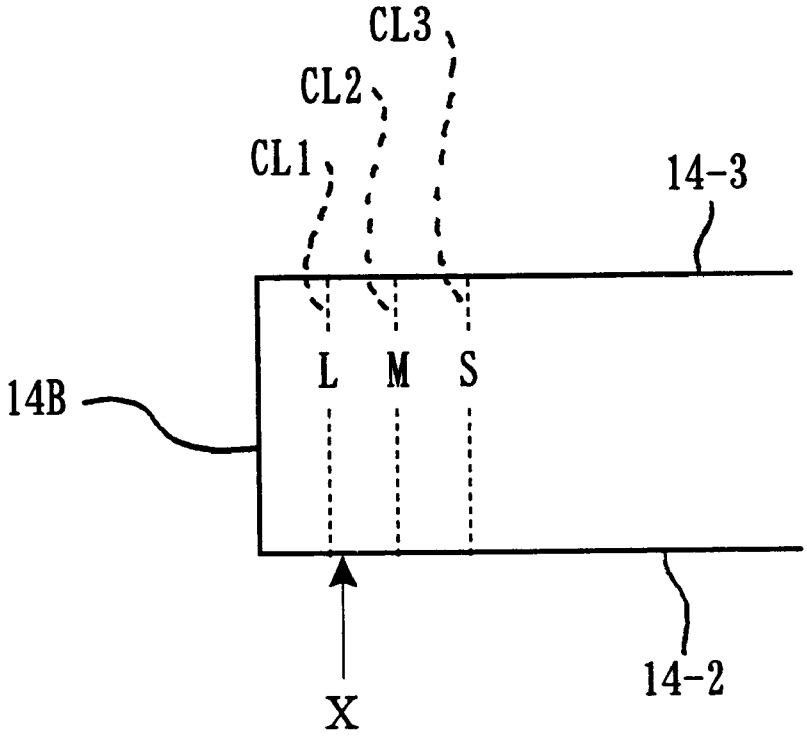
FIG. 3 is a partial enlarged view of the warp-knitted fabric in FIG. 1 and illustrates a sleeve portion of T-shirt integrated into the warp-knitted fabric.

FIG. 3 illustrates, in more detail manner, the arrangement of the guide lines CL1, CL2 and CL3. These guide lines CL1, CL2 and CL3 correspond, respectively, to the cut lines of the standard L (large), M (medium) and S (small) sizes. In other words, the actual cutting by a wearer is not necessarily done along the guide line CL1, CL2 or CL3. Rather, the wearer select one of the lines CL1, CL2 and CL3, which is the closest to the line which can provide the desired sleeve length. Then, under the guide of the selected line, the wearer effects actual cutting in such a manner that the best fitted sleeve length is obtained.

These guide lines CL1, CL2 and CL3 may be knitted portions on the fabric, which are noticeable as less as possible. As an alternative, in addition to the guide lines CL1, CL2 and CL3, expressions such as alphabetical characters L, M and S illustrating sizes are integrally knitted to the fabric. In place of the alphabetical characters L, M and S illustrating sizes, numerical characters such as 1, 2 and 3 can be used. Furthermore, the guide lines CL1, CL2 and CL3 are not necessarily be extended along the entire width of the sleeve and can be extended partially along the sleeve so that they are noticeable as less as possible. The guide lines can be parts of an aesthetic design at the sleeve. In this latter case, the guide lines have knitted structure of different color.

Now, a cutting operation along the selected guide line CL1, CL2 or CL3 will be explained. According to the present invention, T-shirts separated from the fabric in FIG. 1 are, under desirably packed condition, fed to a shop. In this case, the package may include therein a notice to a customer to make him notify that any user can effect a cutting along a desired line. Prior to effect a size adjustment, a wearer decides a desired cut line in accordance with his or her size as well as with his or her preference. In FIG. 3, it is assumed that the wearer selection is, for example, a line along an arrow X in FIG. 3, which provides a sleeve length shorter slightly than the sleeve length at the standard size L and longer greatly than the sleeve length at the standard size M. A cutting by a scissors is done along the line designated by the arrow X. This cutting operation can be easily and reliably done by using, as a guideline, the selected line CL1, which is the closest to the cutting line designated by the arrow X. The wearer or customer can order to a staff member at a shop to make cutting. As an alternative, the wearer can himself or herself effect the cutting.

In short, the garment according to the present invention has a plurality of cut lines or guide lines for providing predetermined sleeve lengths, one of which is selected by a wearer for guiding him or her to effect a cutting, thereby allowing to obtain a desired sleeve length, which is best fitted to the wearer actual size as well as his or her preference.

The above embodiment is directed to a provision of cutting indicators at the sleeve portion of a garment for obtaining a desired sleeve length. The present invention may also encompass an idea that the garment is provided with similar indications at the area adjacent an hemline of a garment and that a cutting is effected while using a selected indication as a guide line in such a manner that a desired body length is obtained. Furthermore, the present invention may also encompass an idea that indications can, in a similar way, be provided at a neck area of T-shirts as a garment, one of which is used for effect a cutting in such a manner that desired shape or size of neck hole of T-shirt is obtained.

An important point according to the present invention is that the fabric incorporated therein with T-shirts as garments is formed as a warp-knitted fabric. As well known to those skilled in this art, the warp-knitted fabric is provided with a complicated entangled structure between warp yarn loops in the direction transverse to the warp direction. Thus, a cutting along a freely decided line at sleeve portion as explained with reference to FIG. 3 does not cause the yarns to be loosened. This nature of the warp-knitted fabric is advantages in relation to the present invention since, since any subsequent sewing process can be eliminated, which will otherwise be necessary in order to prevent a loosening from being occurred at the cut line at the sleeve portion of the garment.

Figure 4:
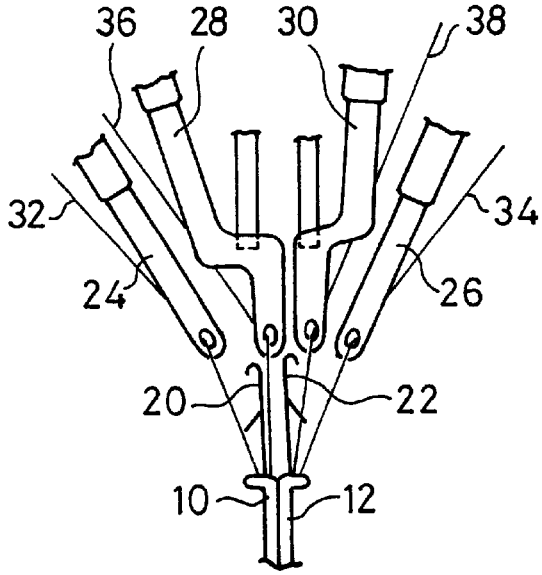
FIG. 4 is a schematic view illustrating an example of a warp knitting machine for knitting a fabric in FIG. 1.

FIG. 4 schematically illustrates a raschel warp knitting machine which can be used for practicing the present invention, which is provided with two rows (beds) of needles 20 and 22, two rows of ground guide bars 24 and 26, corresponding respectively to the needle beds, and two rows of jacquard guide bars 28 and 30. Warp yarns 32 for constructing the first layer 10 are passed through the ground guide bar 24, while warp yarns 34 for constructing the second layer 12 are passed through the ground guide bar 26. At the non-stitched parts of the fabric in FIG. 1, a warp knitting of the first layer 10 by the warp yarns 32 is. done by the needles 20 of the first row and the ground guide bar 24, while a warp knitting of the second layer 12 by the warp yarns 34 is done by the needles 22 of the second row and the ground guide bar 26. Thus, at the non-stitched parts, the first and second layers 10 and 12 which are separated are obtained. The warp yarns 36 and 38 are passed through the jacquard guide bars 28 and 30, respectively, which stitch the first and second layers 10 and 12 by the warp yarns 36 and 38 along the outline 14 of the garment in FIG. 1, thereby obtaining a construction wherein the first and second layers 10 and 12 are connected along the outline of the garment.

The construction of the warp knitting machine in FIG. 4 is the same as described in JII (Japanese Institution of Invention and Innovation) Journal of Technological Disclosure (Kogi) No. 86-5822. Furthermore, the present invention can practice by a warp knitting machine as described in Japanese Examined (Kokoku) Patent Publication No. 52-12306 and Japanese Unexamined Utility Model Publication (Kokai) No. 62-153304.

What is claimed is:

1. A warp knitted fabric for cutting therefrom garments, said warp knitted fabric comprising layers which are separated from each other and which are to be front and back bodies of the garments, said warp knitted fabric having patterns repeated along the length of the fabric, said patterns corresponding to outlines of said garments, said warp knitted fabric comprising stitched parts for connecting said separated layers along said outlines except at locations where parts of a human body are passed, said warp knitted fabric further comprising, at said locations, indicators integrated in the warp knitted fabric for guiding a wearer to effect a size adjustment by cutting.

2. A warp knitted fabric according to claim 1, wherein said indicators are marks which are indicative of sizes at said locations where parts of a human body are passed.

* * * * *